US009046818B2

(12) United States Patent
Sato

(10) Patent No.: US 9,046,818 B2
(45) Date of Patent: Jun. 2, 2015

(54) DEVELOPMENT DEVICE AND IMAGE FORMING APPARATUS

(71) Applicant: Oki Data Corporation, Tokyo (JP)

(72) Inventor: Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/286,498

(22) Filed: May 23, 2014

(65) Prior Publication Data

US 2014/0348555 A1 Nov. 27, 2014

(30) Foreign Application Priority Data

May 24, 2013 (JP) ..... 2013-109676

(51) Int. Cl.
*G03G 15/08* (2006.01)

(52) U.S. Cl.
CPC ..... *G03G 15/0865* (2013.01); *G03G 15/0808* (2013.01)

(58) Field of Classification Search
CPC ..... G03G 15/0808; G03G 15/0865; G03G 2215/0648
See application file for complete search history.

(56) References Cited

U.S. PATENT DOCUMENTS 5,166,472 A * 11/1992 Maeda et al. ..... 399/281
8,041,251 B2 * 10/2011 Nishi et al. ..... 399/103
8,693,928 B2 * 4/2014 Kawashima ..... 399/284

FOREIGN PATENT DOCUMENTS

JP 10-039628 A 2/1998
JP 2000194191 A * 7/2000

* cited by examiner

*Primary Examiner* — Gregory H Curran
(74) *Attorney, Agent, or Firm* — Muncy, Geissler, Olds & Lowe, P.C.

(57) ABSTRACT

A development device includes a developer container that contains developer; a rotatable electrostatic latent image carrier that forms an electrostatic latent image thereon, being arranged below the developer container; a rotatable developer carrier that provides the developer to the electrostatic latent image carrier so that the electrostatic latent image is developed with the developer to form a developer image; and rotatable first and second developer supply members that supply the developer to the developer carrier. Wherein the first developer supply member and the second developer supply member are arranged next to each other and facing the developer carrier, and an outer diameter (D12) of a central portion of the first developer supply member in a rotation axis direction is smaller than outer diameters (D11, D13) of two end portions of the first developer supply member.

14 Claims, 10 Drawing Sheets

*Fig. 9*

Table 1: Continuous Durable Printing Results

| Test | 2nd Supply Roller 26 (Upstream Side) | | | | | | | | 1st Supply Roller 25 (Downstream Side) | | | | | | | | Absolute Value Diff. Down-Up Streams | | |
|---|---|---|---|---|---|---|---|---|---|---|---|---|---|---|---|---|---|---|---|
| | D21 | D22 | D23 | Dia. Diff. | N21 | N22 | N23 | Nip Diff. | D11 | D12 | D13 | Dia. Diff. | N11 | N12 | N13 | Nip Diff. | Dia. Diff. | Nip Diff. | Vertical Streak |
| (1) | 14.0 | 14.0 | 14.0 | 0.0 | 0.5 | 0.5 | 0.5 | 0.0 | 14.0 | 14.2 | 14.0 | 0.2 | 0.5 | 0.6 | 0.5 | 0.1 | 0.2 | 0.1 | × |
| (2) | 14.0 | 14.0 | 14.0 | 0.0 | 0.5 | 0.5 | 0.5 | 0.0 | 14.0 | 14.0 | 14.0 | 0.0 | 0.5 | 0.5 | 0.5 | 0.0 | 0.0 | 0.0 | × |
| (3) | 14.0 | 14.0 | 14.0 | 0.0 | 0.5 | 0.5 | 0.5 | 0.0 | 14.0 | 13.8 | 14.0 | −0.2 | 0.5 | 0.4 | 0.5 | −0.1 | 0.2 | 0.1 | ○ |
| (4) | 14.0 | 14.0 | 14.0 | 0.0 | 0.5 | 0.5 | 0.5 | 0.0 | 14.0 | 13.6 | 14.0 | −0.4 | 0.5 | 0.3 | 0.5 | −0.2 | 0.4 | 0.2 | ○ |
| (13) | 14.0 | 14.2 | 14.0 | 0.2 | 0.5 | 0.6 | 0.5 | 0.1 | 14.0 | 13.6 | 14.0 | −0.4 | 0.5 | 0.3 | 0.5 | −0.2 | 0.2 | 0.1 | ◎ |
| (14) | 14.0 | 14.4 | 14.0 | 0.4 | 0.5 | 0.7 | 0.5 | 0.2 | 14.0 | 13.6 | 14.0 | −0.4 | 0.5 | 0.3 | 0.5 | −0.2 | 0.0 | 0.0 | ◎ |
| (15) | 14.0 | 14.6 | 14.0 | 0.6 | 0.5 | 0.8 | 0.5 | 0.3 | 14.0 | 13.6 | 14.0 | −0.4 | 0.5 | 0.3 | 0.5 | −0.2 | −0.2 | −0.1 | ◎ |
| (16) | 14.0 | 14.8 | 14.0 | 0.8 | 0.5 | 0.9 | 0.5 | 0.4 | 14.0 | 13.6 | 14.0 | −0.4 | 0.5 | 0.3 | 0.5 | −0.2 | −0.4 | −0.2 | ◎ |

*Fig. 10*

Table 2: Continuous Durable Printing Results

| Test | Development Bias Voltage Vd [-V] | 2nd Supply Bias Voltage Vs2 (Upstream Side) [-V] | 1st Supply Bias Voltage Vs1 (Downstream Side) [-V] | Vertical Streaks Occurrence Drum Counts |
|---|---|---|---|---|
| (21) | 250 | 300 | 300 | 80000 |
| (22) | 250 | 275 | 300 | 81000 |
| (23) | 250 | 250 | 300 | 81000 |
| (24) | 250 | 300 | 325 | 83000 |
| (25) | 250 | 300 | 350 | 85000 |
| (26) | 250 | 300 | 375 | 88000 |

DEVELOPMENT DEVICE AND IMAGE FORMING APPARATUS

CROSS REFERENCE TO RELATED APPLICATION

The present application is related to, claims priority from and incorporates by reference Japanese Patent Application No. 2013-109676, filed on May 24, 2013.

TECHNICAL FIELD

The present invention relates to a development device of an electrophotographic printer, a photocopy apparatus and the like, and an image forming apparatus.

BACKGROUND

Conventionally, in image forming apparatus, a photosensitive drum as an image carrier is charged by a charging roller as a charging member, an electrostatic latent image is written, with an LED as an exposure member, to the charged photosensitive drum, and the electrostatic latent image part is developed with toner by a development roller as a developer carrier. However, there is configuration in which, by a pair of supply rollers as developer supply members that are in contact with the development roller, toner is supplied to the development roller and, further, undeveloped toner on the development roller is scraped off (for example, Japanese Patent Laid-Open Publication No. HEI 10-39628 (page 4, FIG. 1)).

The toner in a toner container is supplied from a top central portion and sequentially moves toward two end portions. Further, since a commonly image-formed pattern is mostly in the central portion, toner consumption amount due to printing is larger at the central portion than at the two end portions. Therefore, in the conventional apparatus, there is a problem that, along with printing, fresh toner tends to be sequentially supplied and consumed at the central portion. On the other hand, old toner tends to remain at the two end portions as being pushed and is likely to agglomerate; the agglomerated toner clogs between the development roller and a development blade so that vertical streaks are likely to occur on a print image.

A development device disclosed in the application includes a developer container that contains developer; a rotatable electrostatic latent image carrier that forms an electrostatic latent image thereon, being arranged below the developer container; a rotatable developer carrier that provides the developer to the electrostatic latent image carrier so that the electrostatic latent image is developed with the developer to form a developer image; and rotatable first and second developer supply members that supply the developer to the developer carrier. Wherein the first developer supply member and the second developer supply member are arranged next to each other and facing the developer carrier, and an outer diameter (D12) of a central portion of the first developer supply member in a rotation axis direction is smaller than outer diameters (D11, D13) of two end portions of the first developer supply member.

According to the present invention, a flow path of the developer is formed over the entire developer container so that aggregation of the developer that is likely to occur at the end portions in the container is suppressed and thus occurrence of vertical streaks on a print image can be suppressed.

BRIEF DESCRIPTION OF THE DRAWINGS

FIG. 9 illustrates Table 1 that is continuous durable printing results.

FIG. 10 illustrates Table 2 that is continuous durable printing results.

DETAILED DESCRIPTION OF THE EMBODIMENTS

First Embodiment

Figure 1:
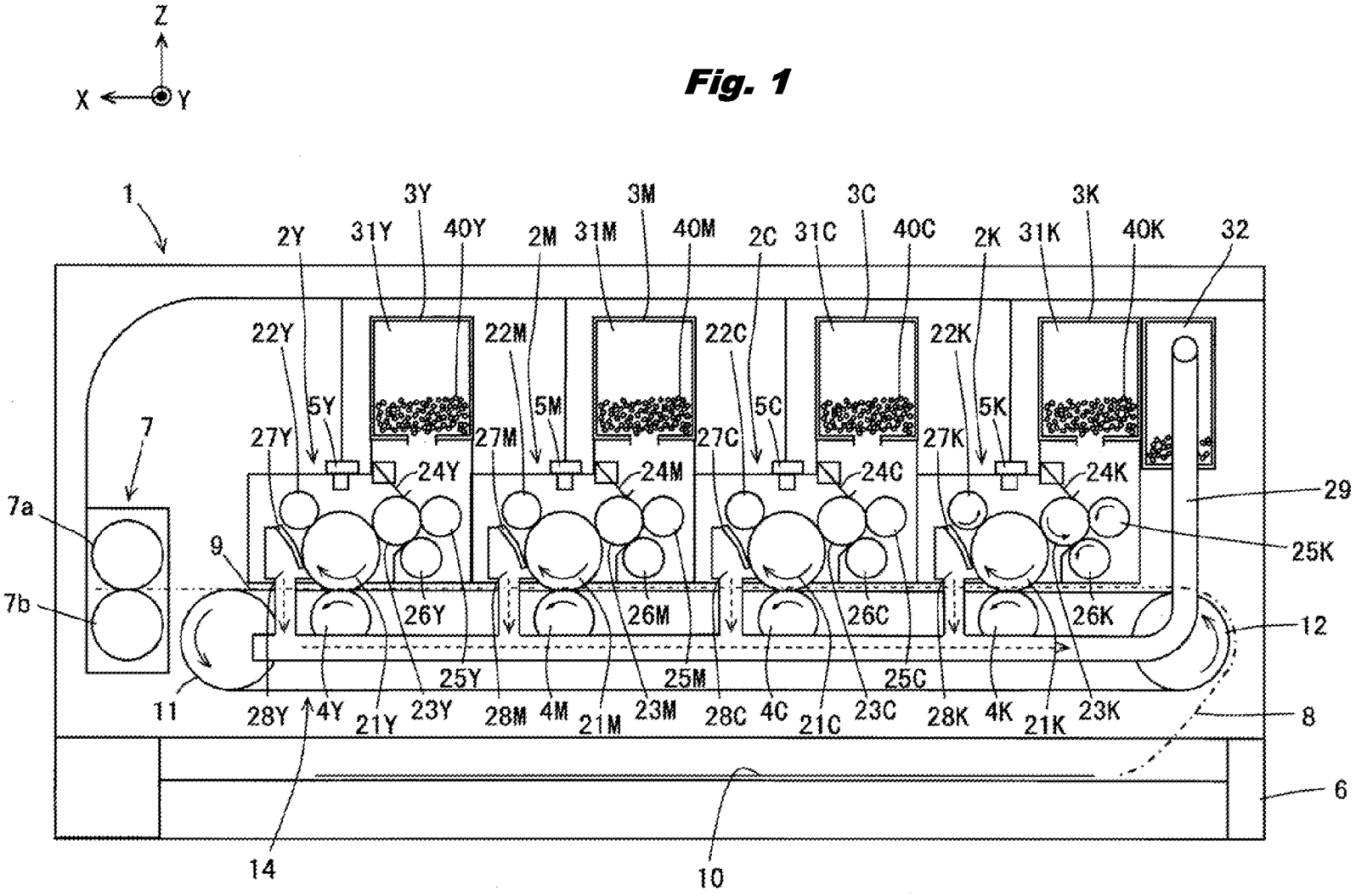
FIG. 1 illustrates a main part configuration diagram that schematically illustrates a main part configuration of a printer that is provided with a development unit according to the present invention.

FIG. 1 illustrates a main part configuration diagram that schematically illustrates a main part configuration of a printer that is provided with a development unit according to the present invention As illustrated in FIG. 1, a printer 1 as an image forming apparatus is provided with development units 2K, 2C, 2M, 2Y (which may be simply referred to as the development unit(s) 2 when it is not necessary to particularly distinguish between them) of respective colors including black (K), cyan (C), magenta (M) and yellow (Y), toner cartridges 3K, 3C, 3M, 3Y (which may be simply referred to as the toner cartridge(s) 3 when it is not necessary to particularly distinguish between them) of the respective colors, a transfer unit 14, exposure units 5K, 5C, 5M, 5Y (which may be simply referred to as the exposure unit(s) 5 when it is not necessary to particularly distinguish between them), a sheet feeding cassette 6 that stores and supplies a recording sheet 10 as a recording medium, a fuser unit 7 that fuses a toner image onto the recording sheet 10, and the like.

The development units 2 as development devices are arranged in an order of the development unit 2K, the development unit 2C, the development unit 2M and the development unit 2Y along a carrying path of the recording sheet 10 due to the transfer unit 14 in a direction from a supply side (upstream side in a sheet carrying direction) toward an ejection side (downstream side in the sheet carrying direction), and respectively removably configured with respect to a body of the printer 1. With respect to each removable or movable configuration element such as the development units 2 of the printer 1, a portion excluding the configuration element may be referred to as the body of the printer 1.

The toner cartridges 3K, 3C, 3M, 3Y (see FIG. 1) are respectively provided with toner storage parts 31K, 31C, 31M, 31Y (which may be simply referred to as the toner storage part(s) 31 when it is not necessary to particularly distinguish between them) that respectively contain unused toners 40K, 40C, 40M, 40Y (which may be simply referred to as the toner(s) 40 when it is not necessary to particularly distinguish between them). The toner cartridges 3K, 3C, 3M, 3Y are respectively removably configured at upper parts of the corresponding development units 2K, 2C, 2M, 2Y and, in an installed state, supply the unused toner 40 to the corresponding development units 2. An agitation-supply mechanism (not illustrated in the drawings) is provided inside each of the toner storage parts 31.

The development units 2K, 2C, 2M, 2Y all have the same structure, and are respectively provided with photosensitive drums 21K, 21C, 21M, 21Y (which may be simply referred to as the photosensitive drum(s) 21 when it is not necessary to particularly distinguish between them) as electrostatic latent image carriers, charging rollers 22K, 22C, 22M, 22Y (which may be simply referred to as the charging roller(s) 22 when it is not necessary to particularly distinguish between them), development rollers 23K, 23C, 23M, 23Y (which may be simply referred to as the development roller(s) 23 when it is not necessary to particularly distinguish between them) as developer carriers, development blades 24K, 24C, 24M, 24Y (which may be simply referred to as the development blade(s) 24 when it is not necessary to particularly distinguish between them), first supply rollers 25K, 25C, 25M, 25Y (which may be simply referred to as the first supply roller(s) 25 when it is not necessary to particularly distinguish between them) as first developer supply members, second supply rollers 26K, 26C, 26M, 26Y (which may be simply referred to as the second supply roller(s) 26 when it is not necessary to particularly distinguish between them) as second developer supply members, cleaning blades 27K, 27C, 27M, 27Y (which may be simply referred to as the cleaning blade(s) 27 when it is not necessary to particularly distinguish between them), and first carrying parts 28K, 28C, 28M, 28Y (which may be simply referred to as the first carrying part(s) 28 when it is not necessary to particularly distinguish between them), and the like.

Each of the first carrying parts 28, as will be described later, carries waste toner that is removed by a corresponding cleaning blade 27 toward an upper side of the paper of FIG. 1 (a plus direction of a Y-axis, which will be described later), which is an axial direction of the photosensitive drums 21. A second carrying part 29 collectively carries the waste toner carried in by the first carrying parts 28 to a waste toner container 32 that is arranged on a more upstream side in the sheet carrying direction than the development unit 2K. The waste toner container 32 contains the waste toner carried in by the second carrying part 29 and is removably provided with respect to the body of the printer 1.

X, Y and Z axes in FIG. 1 are set as follows. The X axis is along the carrying direction when the recording sheet 10 passes through the four development units 2. The Y axis is along a rotation axis direction of the photosensitive drums 21. The Z axis is along a direction orthogonal to the X and Y axes. Further, when the X, Y and Z axes are illustrated in other drawings (to be described later), directions of these axes indicate common directions. That is, the X, Y and Z axes in each of the drawings indicate arrangement directions when illustrated portions in the each of the drawings configure the image forming apparatus 1 illustrated in FIG. 1. Here, it is assumed that the printer 1 is arranged in such a manner that the Z axis is along a substantially vertical direction.

Figure 2:
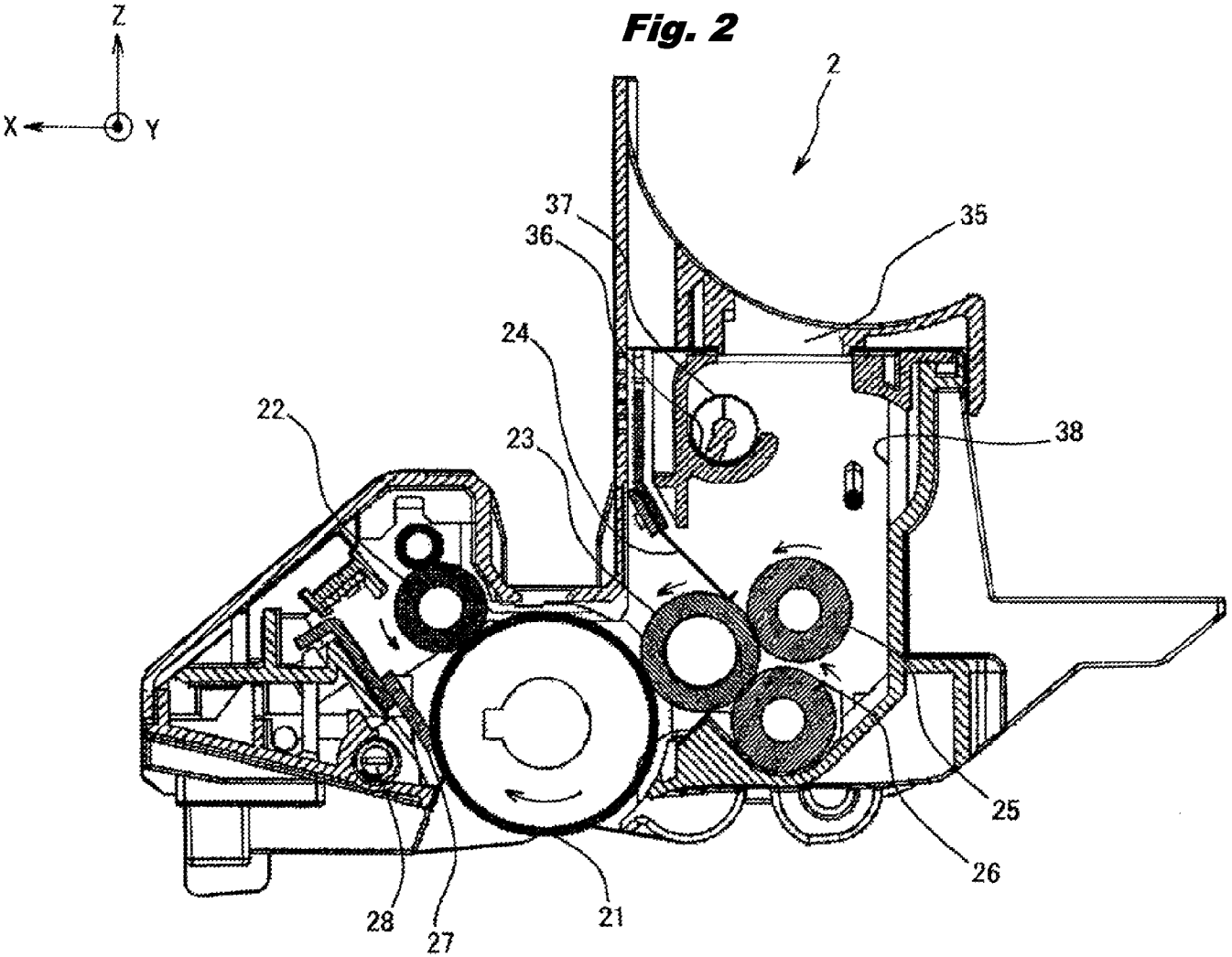
FIG. 2 illustrates a schematic configuration diagram that schematically illustrates an internal configuration of the development unit according to the present invention.

FIG. 2 illustrates a schematic configuration diagram that schematically illustrates an internal configuration of the development unit 2. With reference to FIG. 2, the configuration of the development unit 2 is further described.

The development unit 2 is provided with the photosensitive drum 21; the charging roller 22 that uniformly charges a surface of the photosensitive drum 21; the development roller 23 that attaches the toner 40 (FIG. 1) to an electrostatic latent image that is formed on the surface of the photosensitive drum 21 by the exposure unit 5 (FIG. 1) and develops the image; the development blade 24 that regulates a layer thickness of the toner 40 that is supplied to the development roller 23; the first and second supply rollers 25, 26 that supply the toner 40 to the development roller 23 and further scrape off undeveloped toner on the development roller 23; the cleaning blade 27 that removes the toner 40 that remains on the photosensitive drum 21 without being transferred to the recording sheet 10 (FIG. 1); and the first carrying part 28 that carries as the waste tone the toner 40 that is removed by the cleaning blade 27.

The photosensitive drum 21 is configured by a conductive supporting body and a photoconductive layer, is an organic photosensitive body of a configuration in which a blocking layer, a charge generation layer as a photoconductive layer, and a charge transportation layer are sequentially laminated on a metal pipe of aluminum or the like as a conductive supporting body, and rotates in a clockwise direction (arrow direction) in FIG. 2. Thereby, the recording sheet 10 on a sheet carrying path 8, which is arranged below the photosensitive drum 21, is carried along a plus direction of the X-axis.

The charging roller 22 is connected to a charging roller voltage power source 122 (FIG. 3) that applies a bias voltage of the same polarity as the toner 40, is configured by a metal shaft and a layer of a semiconductive rubber such as an epichlorohydrin rubber, is positioned at a position at which the charging roller 22 is in contact with the photosensitive drum 21 with a predetermined press-contact amount, is driven to rotate in an arrow direction in FIG. 2 by the rotation of the photosensitive drum 21, and uniformly charges the surface of the photosensitive drum 21 with the applied bias voltage.

The development roller 23 is connected to a development roller voltage power source 123 (FIG. 3) that applies a bias voltage of either the same or opposite polarity as the toner 40, is configured by a metal shaft and a semiconductive urethane rubber layer, is positioned at a position at which the development roller 23 is in contact with the photosensitive drum 21 with a predetermined press-contact amount, rotates with a predetermined circumferential speed ratio in an opposite direction (an arrow direction in FIG. 2) with respect to the rotation of the photosensitive drum 21, and attaches the charged toner 40 to an electrostatic latent image part on the photosensitive drum 21 with the applied bias voltage to develop the image.

The development blade 24 is connected to a development roller voltage power source 123 or a supply roller voltage power source 124 (FIG. 3) that applies a bias voltage of either the same or opposite polarity as the toner 40, and is a metal thin plate member of a thickness, for example, of 0.08 [mm] having a width that is substantially the same as a width in a longitudinal direction of the development roller 23. Further, one end of the development blade 24 is fixed and the other end of the development blade 24 is arranged in such a manner that a surface on a lightly inner side from a front end part of the other end is in contact with a circumferential surface of the development roller 23. By the applied bias voltage and a contact pressure, the toner 40 formed on the circumferential surface of the development roller 23 is charged and a layer thickness is regulated.

The first supply roller 25 and the second supply roller 26 are connected to a supply roller voltage power source 124 (FIG. 3) that applies a bias voltage of either the same or opposite polarity as the toner 40, are both configured by a metal shaft and a semiconductive foamed silicon sponge layer, are arranged adjacent to each other at positions at which the first supply roller 25 and the second supply roller 26 are in contact with the development roller 23 with predetermined pressure amounts with axes thereof in parallel to an axis of the development roller 23, rotate with predetermined circumferential speed ratios, as indicated by arrows in FIG. 2, in a same direction with respect to the rotation of the development roller 23 (opposite direction with respect to a contact surface of the development roller 23), and supply, with the bias voltage, the toner 40 that is replenished from the toner storage parts 31 provided in the toner cartridge 3 to the development roller 23. Further, due to contact friction forces of the first supply roller 25 and the second supply roller 26 with the development roller 23, the toner 40 is charged, and undeveloped toner on the development roller 23 is scraped off. The above predetermined pressure amounts of the present invention are determined considering several technical points. For example, one of the predetermined pressure amounts is defined as a pressure amount by which most toner attached on a supply roller surface is conveyed to a development roller surface. Also, when the supply and development rollers pushes each other and create friction force so that toner on their surfaces is charged enough by the friction force, the pressure amount between the rollers may be defined as the predetermined pressure amount of the present invention. When a pressure amount is applied to a development roller surface in order to scrap a toner that remains on the development roller, the pressure amount as well may be defined as the predetermined pressure amount of the present invention.

The cleaning blade 27 is a urethane rubber member that is arranged at a position at which one end of the cleaning blade 27 is in contact with the photosensitive drum 21 with a predetermined press-contact amount. The first carrying part 28 carries, as waste toner, the toner 40 and attached matter that are removed by the cleaning blade 27 toward an upper side of the paper of FIG. 2 (the plus direction of the Y-axis), which is the axial direction of the photosensitive drum 21.

A toner supply port 35 is provided at a substantially central region in a longitudinal direction (Y-axis direction) of the toner cartridge 3 and the development unit 2 (see FIG. 7), and is opened with predetermined dimensions at a connection port that supplies unused toner 40 from the toner cartridge 3 (FIG. 1) that is installed on the development unit 2 to a toner container 38 inside the development unit 2. A toner receiving part 36 (see FIG. 7) is formed, as will described later, at an upper part of a wall of the toner container 38 and in a substantially central region in a longitudinal direction, extending over a region wider than the toner supply port 35, and receives a part of the toner 40 supplied from the toner supply port 35. A toner agitation mechanism 37 is a rotation member having a spiral shape and carries the toner 40 received by the toner receiving part 36 toward two end portions while agitating the toner 40.

The development unit 2, the toner cartridge 3, the waste toner container 32 and the like are all replacement units and any one of them can be replaced when life thereof ends due to that toner has been consumed or due to that a component has deteriorated.

In FIG. 1, the exposure units 5K, 5C, 5M, 5Y are LED (Light Emitting Diode) heads that are provided with light emitting elements such as LEDs and lens arrays, and respectively irradiate surfaces of the photosensitive drums 21K, 21C, 21M, 21Y with light according to print data that the printer 1 inputs and optically attenuate electric potential of an exposed portion to form an electrostatic latent image.

The sheet feeding cassette 6 contains therein the recording sheet 10 in a stacked state, and is removably installed at a lower part of the printer 1. At an upper part of the sheet feeding cassette 6 on a sheet feeding side, a sheet feeding part (not illustrated in the drawings) is arranged that is provided with a hopping roller and the like, the hopping roller feeding the recording sheet 10 one by one to a sheet carrying path 8 (indicated by a dashed line in FIG. 1). Carrying rollers (not illustrated in the drawings) are arranged at key places of the sheet carrying path 8 to sequentially carry the recording sheet 10 to downstream sides.

The transfer unit 14 is provided with a transfer belt 9 that electrostatically adsorbs the recording sheet 10 and carries the recording sheet 10 to downstream sides, a drive roller 11 that is rotated by a drive part (not illustrated in the drawings) in an arrow direction to drive the transfer belt 9, a tension roller 12 that is paired with the drive roller to stretch the transfer belt 9, and transfer rollers 4K, 4C, 4M, 4Y (which may be simply referred to as the transfer roller(s) 4 when it is not necessary to particularly distinguish between them) that are arranged to respectively oppose and be in press-contact with the photosensitive drums 21K, 21C, 21M, 21Y via the transfer belt 9 and rotate in arrow directions to transfer toner images to the recording sheet 10.

The transfer rollers 4 are connected to a transfer roller voltage power source 114 (FIG. 3) that applied a bias voltage of the opposite polarity as the toner 40, and, with the applied bias voltage, sequentially superimpose the toner images that are respectively formed on the photosensitive drums 21 and transfer the images to the recording sheet 10.

The fuser unit 7 is arranged on a downstream side of the development units 2 in the sheet carrying path 8 and is provided with a heat application roller 7*a*, a pressure application roller 7*b*, a thermistor and a heat application heater (the thermistor and the heat application heater are not illustrated in the drawings). The heat application roller 7*a* is formed by covering a hollow cylindrical core shaft made of, for example, aluminum with a heat-resistant elastic layer of silicone rubber, and having a PFA (tetrafluoroethylene-perfluoroalkyl vinyl ether copolymer) tube covering thereon. Inside the core shaft, a heat application heater such as a halogen lamp is provided. The pressure application roller 7*b* has a configuration in which a core shaft made of, for example, aluminum is covered with a heat-resistant elastic layer of silicone rubber and a PFA tube covers thereon, and is arranged in such a manner that a press-contact part is formed between the pressure application roller 7*b* and the heat application roller 7*a*. The thermistor is a surface temperature detection means of the heat application roller 7*a* and is arranged in a non-contact manner in a vicinity of the heat application roller 7*a*.

The surface temperature of the heat application roller 7*a* is maintained at a predetermined temperature by the heat application heater, which performs temperature control based on the surface temperature of the heat application roller 7*a* that is detected by the thermistor. When the recording sheet 10, to which a toner image has been transferred, passes through the press-contact part that is formed by the heat application roller 7*a*, of which the temperature is managed, and the pressure application roller 7*b*, the toner image is fused on the recording sheet 10 due to the applied heat and pressure.

Figure 3:
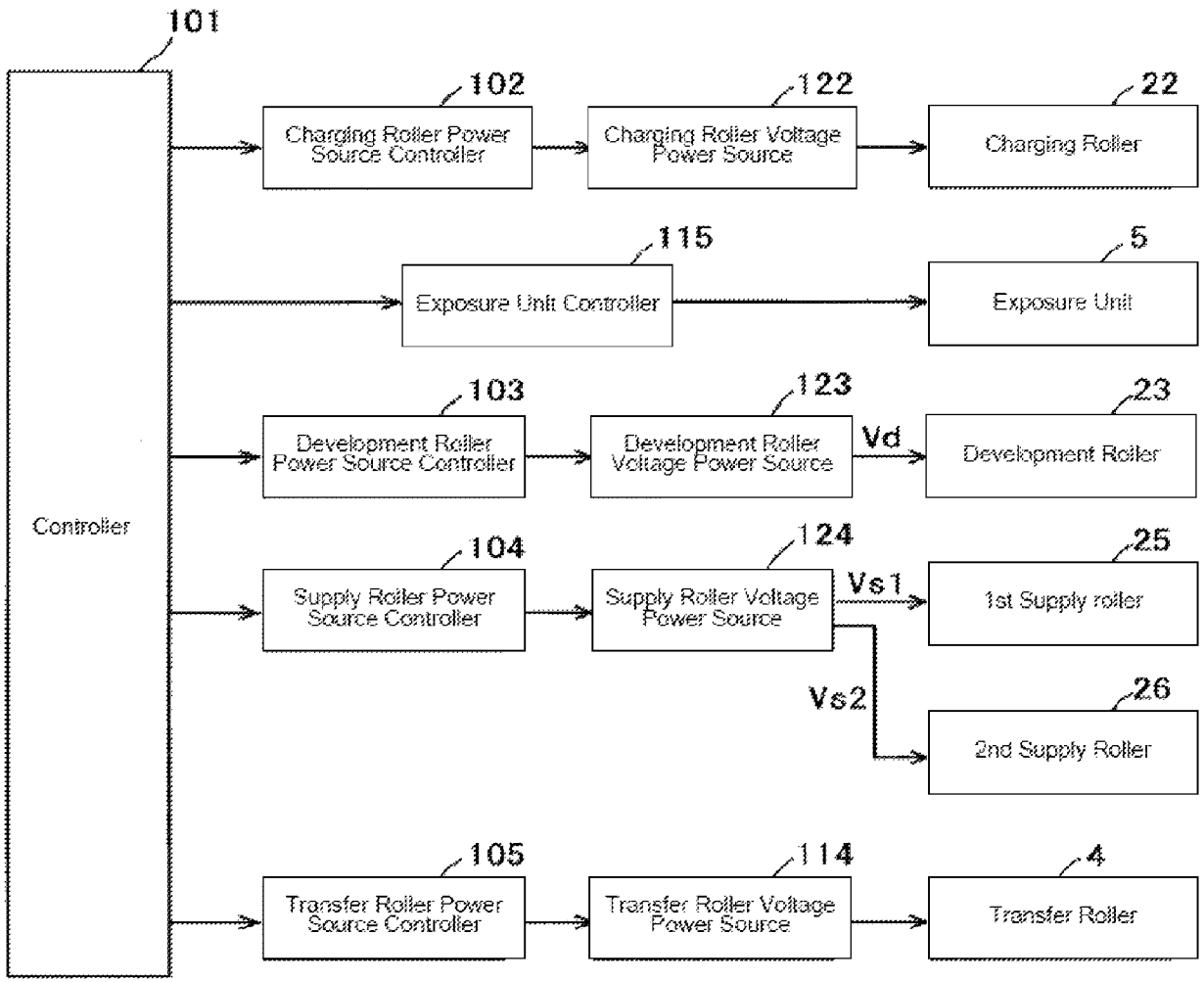
FIG. 3 illustrates a block diagram that illustrates a main part configuration of a portion of a control system of the printer, the portion being involved with the present invention.

FIG. 3 illustrates a block diagram that illustrates a main part configuration of a portion of a control system of the printer 1, the portion being involved with the present invention. In the following, the control system is described with reference to FIGS. 1 and 2.

In FIG. 3, a controller 101 is configured by a microprocessor, a ROM, a RAM, an input and output port, a timer, and the like (which are not illustrated in the drawing) and receives print data and a print command from a host device (not illustrated in the drawing) to perform sequence control of the whole image forming apparatus and to perform a printing operation.

According to an instruction from the controller 101, a charging roller power source controller 102 performs application voltage control for applying a DC bias voltage to the charging roller 22 to charge the surface of the photosensitive drum 21 (FIG. 2). In order to individual control each of the image forming units of the respective colors, the charging roller power source controller 102 has a (K) charging roller power source controller, a (C) charging roller power source controller, an (M) charging roller power source controller and a (Y) charging roller power source controller. However, here, it is not necessary to describe them with particular distinction so they are collectively described.

According to an instruction from the controller 101, an exposure unit controller 115 performs control for irradiating and exposing the charged surface of the photosensitive drum 21 (FIG. 2) with light from the exposure unit 5 (FIG. 1) according to the print data to generate an electrostatic latent image. In order to individual control each of the LED heads of the respective colors, the exposure unit controller 115 has a (K) exposure unit controller, a (C) exposure unit controller, an (M) exposure unit controller and a (Y) exposure unit controller. However, here, it is not necessary to describe them with particular distinction so they are collectively described.

According to an instruction from the controller 101, a development roller power source controller 103 performs application voltage control for applying a DC bias voltage to the development roller 23 for attaching toner to the electrostatic latent image that is generated on the surface of the photosensitive drum 21 (FIG. 1) by the exposure unit 5. In order to individual control each of the image forming units of the respective colors, the development roller power source controller 103 has a (K) development roller power source controller, a (C) development roller power source controller, an (M) development roller power source controller and a (Y) development roller power source controller. However, here, it is not necessary to describe them with particular distinction so they are collectively described.

According to an instruction from the controller 101, a supply roller power source controller 104 performs application voltage control for applying a DC bias voltage to the first supply roller 25 and the second supply roller 26 for supplying toner to the development roller 23 (FIG. 2). In order to individual control each of the image forming units of the respective colors, the supply roller power source controller 104 has a (K) supply roller power source controller, a (C) supply roller power source controller, an (M) supply roller power source controller and a (Y) supply roller power source controller. However, here, it is not necessary to describe them with particular distinction so they are collectively described.

According to an instruction from the controller 101, a transfer roller power source controller 105 performs application voltage control for applying a DC bias voltage to the transfer roller 4 (FIG. 1) for sequentially superimposing the toner images that are generated on the surfaces of the photosensitive drums 21 and transferring the images to the recording sheet 10. In order to individual control each of the transfer rollers of the respective colors, the transfer roller power source controller 105 has a (K) transfer roller power source controller, a (C) transfer roller power source controller, an (M) transfer roller power source controller and a (Y) transfer roller power source controller. However, here, it is not necessary to describe them with particular distinction so they are collectively described.

The charging roller voltage power source 122 applies a DC bias voltage to the charging roller 22 by the application voltage control of the charging roller power source controller 102. The development roller voltage power source 123 applies a DC bias voltage to the development roller 23 by the application voltage control of the development roller power source controller 103. The supply roller voltage power source 124 applies a DC bias voltage to the first supply roller 25 and the second supply roller 26 by the application voltage control of the supply roller power source controller 104. The transfer roller voltage power source 114 applies a DC bias voltage to the transfer roller 4 by the application voltage control of the transfer roller power source controller 105.

Here, an outline of a printing operation of the printer 1 is described with reference to FIGS. 1 and 2.

When printing is started, the printer 1 feeds, with the sheet feeding part (not illustrated in the drawings), the recording sheet 10 from the sheet feeding cassette 6 to the sheet carrying path 8, and further carries, with the transfer belt 9 of the transfer unit 14, the recording sheet 10 to a downstream side. In the carrying process, toner images that are respectively formed by the development units 2K, 2C, 2M, 2Y are sequentially superimposed and transferred to a recording surface of the recording sheet 10 by the transfer rollers 4K, 4C, 4M, 4Y. Further, fusion of the toner images that are transferred to the recording surface is performed by the fuser unit 7. Thereafter, the printed recording sheet 10 is ejected to the outside of the printer 1.

In this case, in the development unit 2, the surface of the photosensitive drum 21 is uniformly charged by the charging roller 22, and an electrostatic latent image is formed on an exposure part that is exposed by the exposure unit 5 according to the print data. Together with this, the toner 40 that is supplied from the toner cartridge 3 is supplied to the development roller 23 by the first and second toner supply rollers 25, 26, and the toner 40 that is supplied to the development roller 23 is uniformized into a toner layer having a uniform thickness by the development blade 24.

The electrostatic latent image that is formed on the photosensitive drum 21 is visualized, that is, developed, by the toner 40 that is uniformized and formed on the development roller 23. The developed toner 40 is electrically transferred to the recording sheet 10 by the transfer roller 4. Residual toner 40 that remains on the surface of the photosensitive drum 21 without being transferred to the recording sheet 10 is scrapped off by the cleaning blade 27 and is eventually contained in the waste toner container 32.

Figure 4:
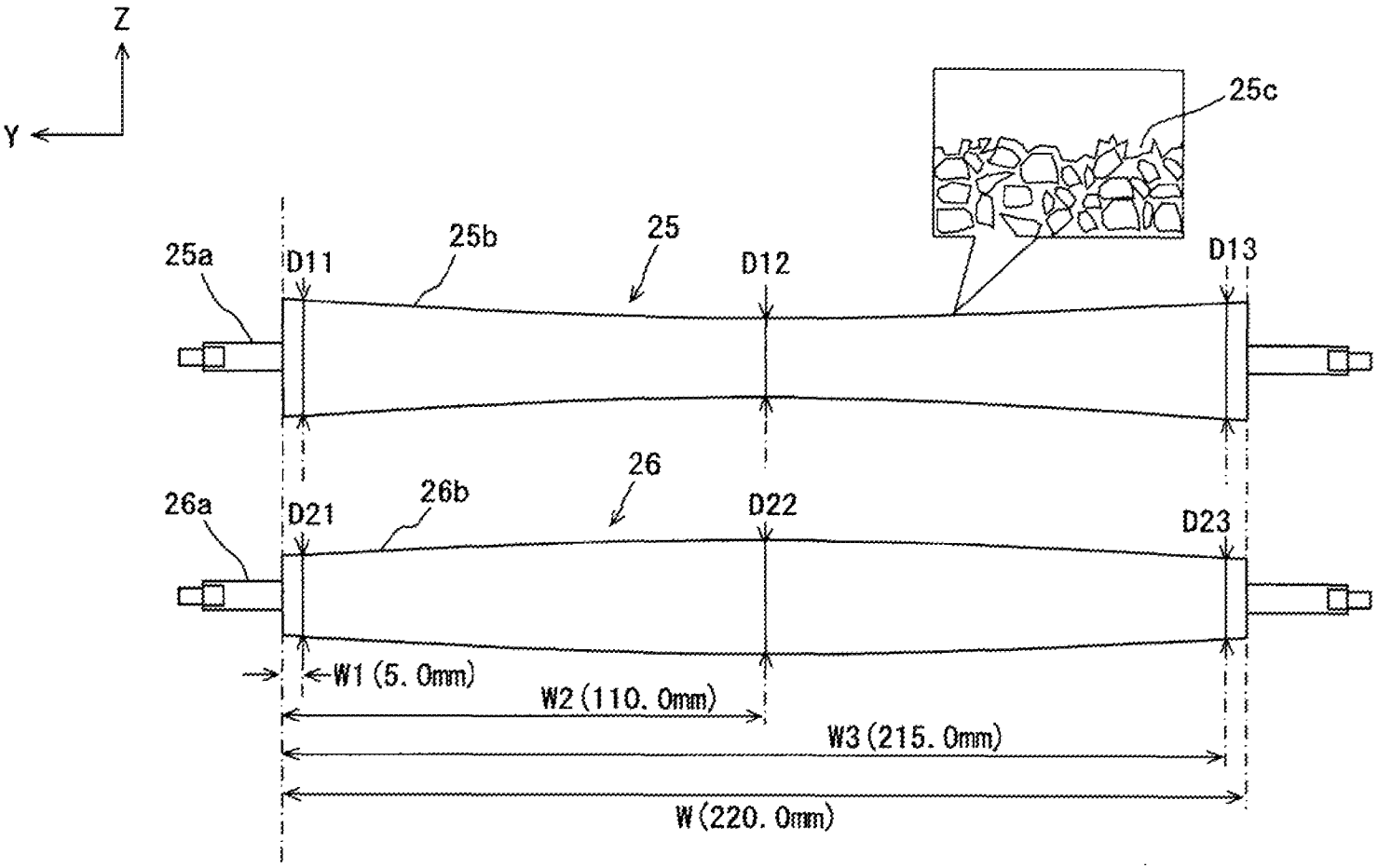
FIG. 4 illustrates a configuration diagram of a first supply roller and a second supply roller and a rectangular balloon part illustrates a partial enlarged view of a vicinity of an indicated position.

The configuration of the development unit 2 is further described. FIG. 4 illustrates a configuration diagram of the first supply roller 25 and the second supply roller 26 and a rectangular balloon part illustrates a partial enlarged view of a vicinity of an indicated position.

The first supply roller 25 is provided with a conductive foam layer 25*b* around a core shaft (shaft) 25*a* and there exist a countless number of cells 25*c* in the conductive foam layer 25*b*.

Examples of rubber materials of the conductive foam layer 25*b* include rubber materials such as silicone rubber or silicone-modified rubber, natural rubber, nitrile rubber, ethylene propylene rubber, EPDM, styrene-butadiene rubber, acrylonitrile-butadiene rubber, butadiene rubber, isoprene rubber, acrylic rubber, chloroprene rubber, butyl rubber, epichlorohydrin rubber, urethane rubber, fluorine rubber and polyether rubber, and elastomers such as polyurethane, polystyrene, polybutadiene block polymer, polyolefin, polyethylene, chlorinated polyethylene, ethylene-vinyl acetate copolymer. One kind or a mixed rubber of two or more kinds of these, or a modified rubber can be used. Further, it is possible to arbitrarily select a material of a millable type or a liquid type for the above rubber materials. In particular, a material of the millable type is preferred.

For the shaft 25*a*, a metal having predetermined rigidity and sufficient conductivity may be use, for example, iron, copper, brass, stainless steel, aluminum, nickel or the like is used. A material other than a metal can also be used as far the material is conductive and has appropriate rigidity. For example, it is possible to use a resin molded product, ceramics and the like, in which conductive particles are dispersed. Further, in addition to a roll shape, the shaft 25*a* may also have a hollow pipe shape. Further, on two ends of the shaft 25*a*, a height difference for gear attachment may be provided and a shape in which a pin hole is present may be formed, so that, as illustrated in FIG. 3, front end bearing parts of the shaft 25*a* may have a diameter smaller than a portion having the conductive foam layer. Similarly, in the second supply roller 26, a core shaft 26*a*, a conductive foam layer 26*b* and cells (not illustrated in the drawings) are formed.

As a manufacturing method of the first supply roller 25, it is common that a reinforcing filler, a vulcanization agent and a foaming agent that are required for vulcanization hardening, and a conductivity imparting agent are added to the above rubber material, and the mixture is thoroughly kneaded by a pressure kneader, a mixing roll or the like; thereafter, a rubber pound in an unvulcanized state is formed on the shaft 25*a* by a method such as extrusion and vulcanization foaming by heat application is performed. Further, it is also possible to form the first supply roller 25 by extruding a rubber pound in a tubular shape in advance, and by vulcanizing and foaming the rubber pound by heat application and molding a sponge rubber tube, and covering the shaft 25*a* with the sponge rubber tube. In this case, as needed, the shaft 25*a* and the conductive foam layer 25*b* may be fixed to each other with an adhesive. Thereafter, the molded first supply roller 25 is cut-machined to have a predetermined outer diameter. The core shaft 26*a* and the conductive foam layer 26*b* of the second supply roller 26 are manufactured by the same method.

As illustrated in FIG. 2, where a contact point (CP) between the development roller 23 and photosensitive drum 21 is defined as a starting point, the second supply roller 26 is positioned on an upstream side with respect to the first supply roller 25 in the rotation direction of the development roller 23. Contrarily, the first supply roller 25 is positioned on a downstream side with respect to the second supply roller 26 in the rotation direction. The first supply roller 25 on the downstream side is formed, as illustrated in FIG. 4, in an inverted crown shape in which an outer diameter D12 of a central portion in the rotation axis direction (Y-axis direction) is smaller than outer diameters D11, D13 of two end portions. Similarly, the second supply roller 26 that is arranged on an upstream side in the rotation direction of the development roller 23 is formed, as illustrated in FIG. 4, in a regular crown shape in which an outer diameter D22 of a central portion in the rotation axis direction is the same as or larger than outer diameters D21, D23 of two end portions. Therefore, contours of outer peripheral surfaces of the conductive foam layers 25*b*, 26*b* that are formed by a common polishing method have curved or straight lines as illustrated in FIG. 4. However, the conductive foam layers 25*b*, 26*b* may also be polished into a not continuous shape having several steps with small gaps (or in a staircase pattern).

(1) The diameters D11 and D13 are not necessarily to be the same size. The diameters D21 and D23 also are not necessarily to be the same size. However, in view of evenly agitating the toner, it is preferred that the pair of rollers D11 and D13 and the pair of rollers D21 and D23 each have the same diameter. More specifically, it is preferred that the supply rollers are formed in a laterally symmetrical shape.

Figure 6:
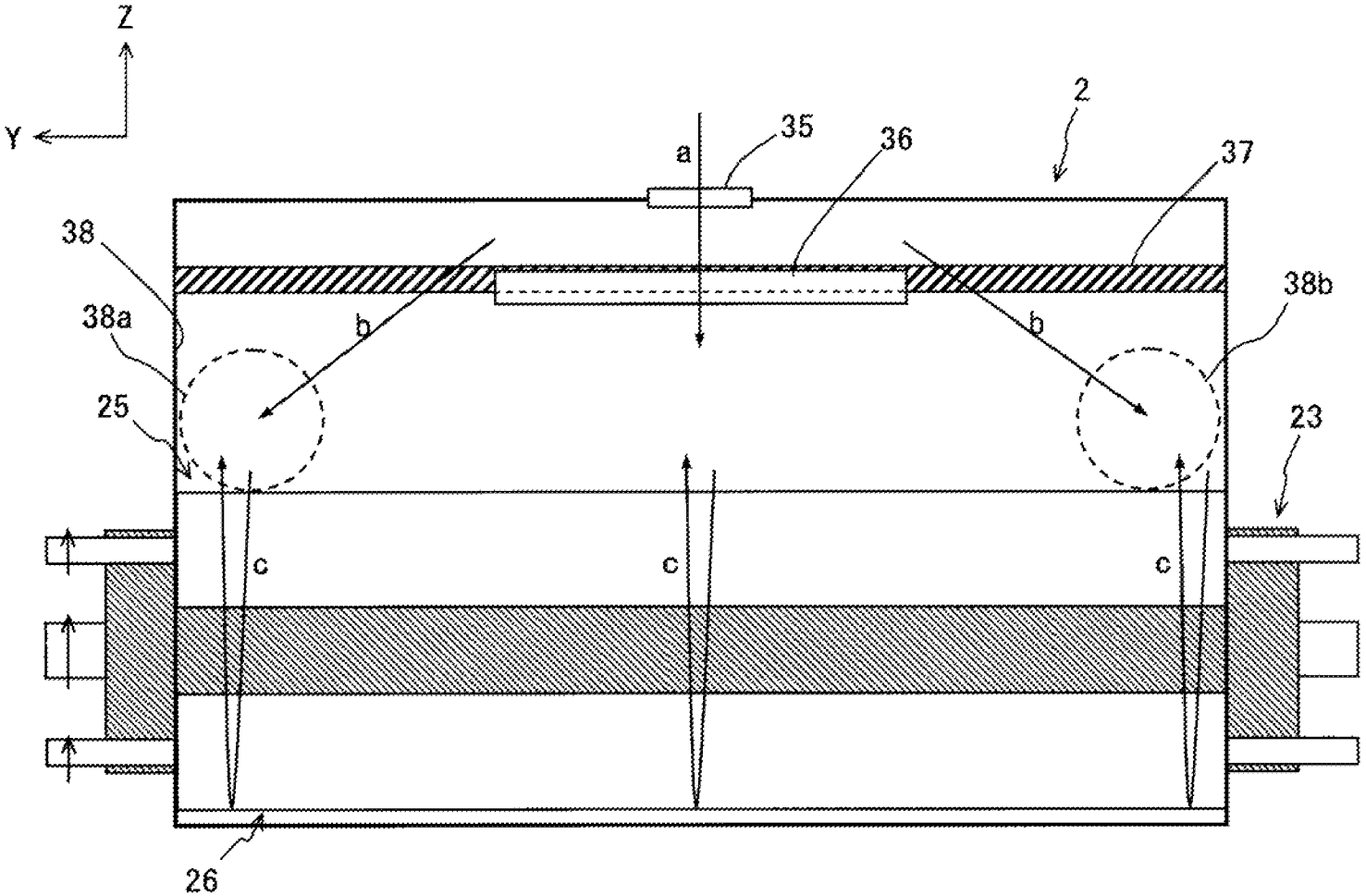
FIG. 6 is for describing a process in which vertical streaks occur in a test (2) of a print test 1.
Figure 7:
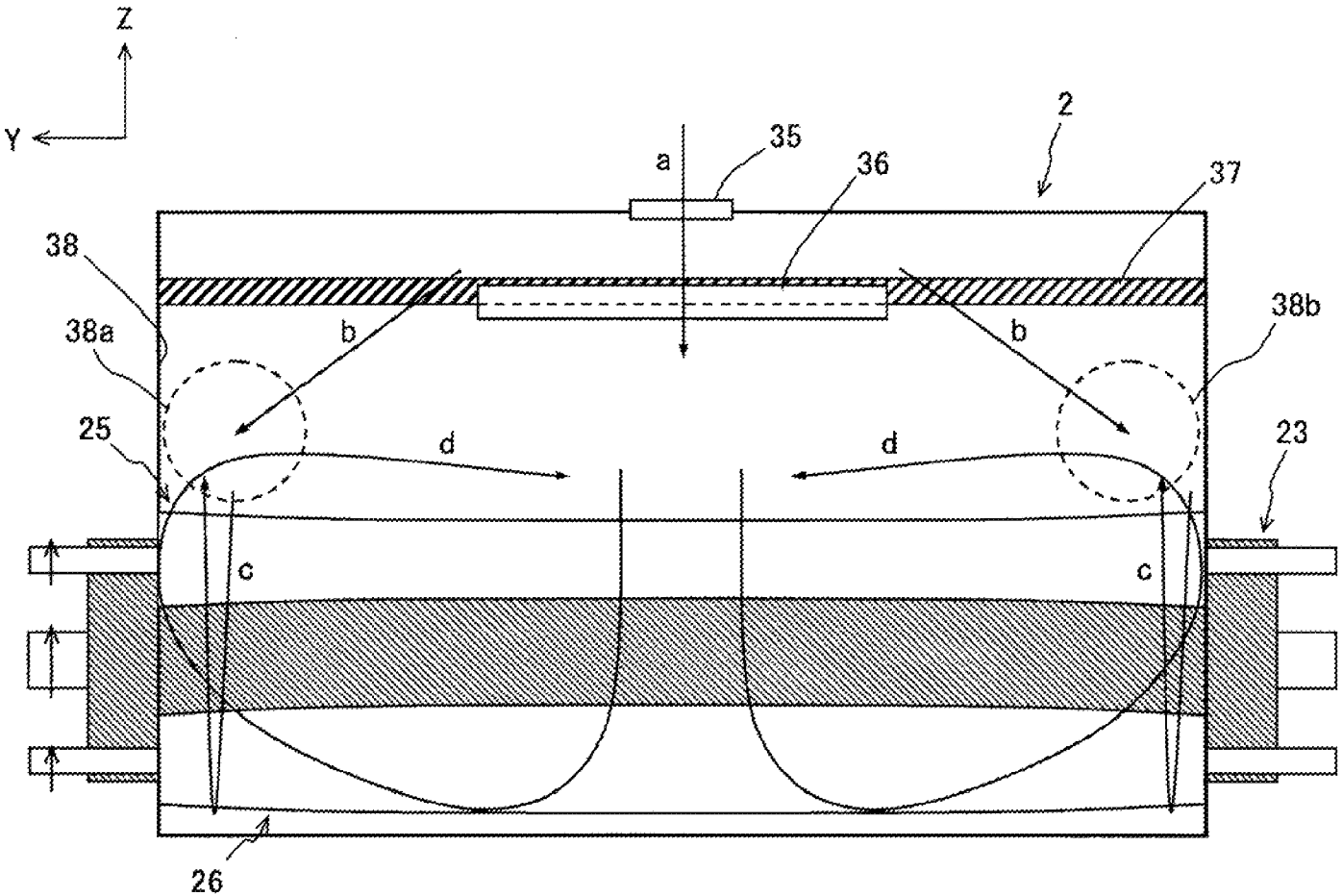
FIG. 7 is for describing a flow of toner of a whole toner container in a test (4) for which an evaluation result was ○ (Good).

(2) In FIGS. 6 and 7, the toner supply port 35 is located at the middle in the Y direction. However, it is practical to position the toner supply port 35 not the middle, but close to right or left side. In such an embodiment, one of the diameters at the distal ends (right or left), to which the toner supply port 35 is positioned close, may be larger than that at the other distal end. More specifically, it is practical to make a diameter that is exactly below the toner supply port 35 smallest. The position of the smallest diameter is defined as a direct port position. The diameter gradually increases in the lateral direction (Y direction) from the direct port position. When the diameter at the direct port position is the largest, the diameter gradually decreases in the lateral direction from the direct port position.

When the first and second supply rollers satisfy the following equations:

$$D12<D11,\ D12<D13 \qquad \text{eq (1)}$$

$$D22\geq D21,\ D22\geq D23 \qquad \text{eq (2)}$$

As illustrated in FIG. 4, measurement positions of the outer diameters D11, D12, D13 are respectively positions of distances W1 (5.0 mm), W2 (110.0 mm) and W3 (215.0 mm) away from one end of the conductive foam layer 25*b*. Similarly, measurement positions of the outer diameters D21, D22, D23 are respectively positions of the distances W1 (5.0 mm), W2 (110.0 mm) and W3 (215.0 mm) away from one end of the conductive foam layer 26*b*. Here, the conductive foam layers 25*b*, 26*b* have a width W of 220 mm.

The development roller 23 is arranged parallel respectively to the first and second supply rollers. Therefore, for a contact nip amount N1 between the first supply roller 25 and the development roller 23, a central portion nip amount N12 of the central portion is smaller than end portion nip amounts N11, N13; and for a contact nip amount N2 between the second supply roller 26 and the development roller 23, a central portion nip amount N22 of the central portion is the same as or larger than end portion nip amounts N21, N23. The first and second supply rollers satisfy the following equations:

$$N12<N11,\ N12<N13 \qquad \text{eq (1)}$$

$$N22\geq N21,\ N22\geq N23 \qquad \text{eq (2)}$$

Figure 5:
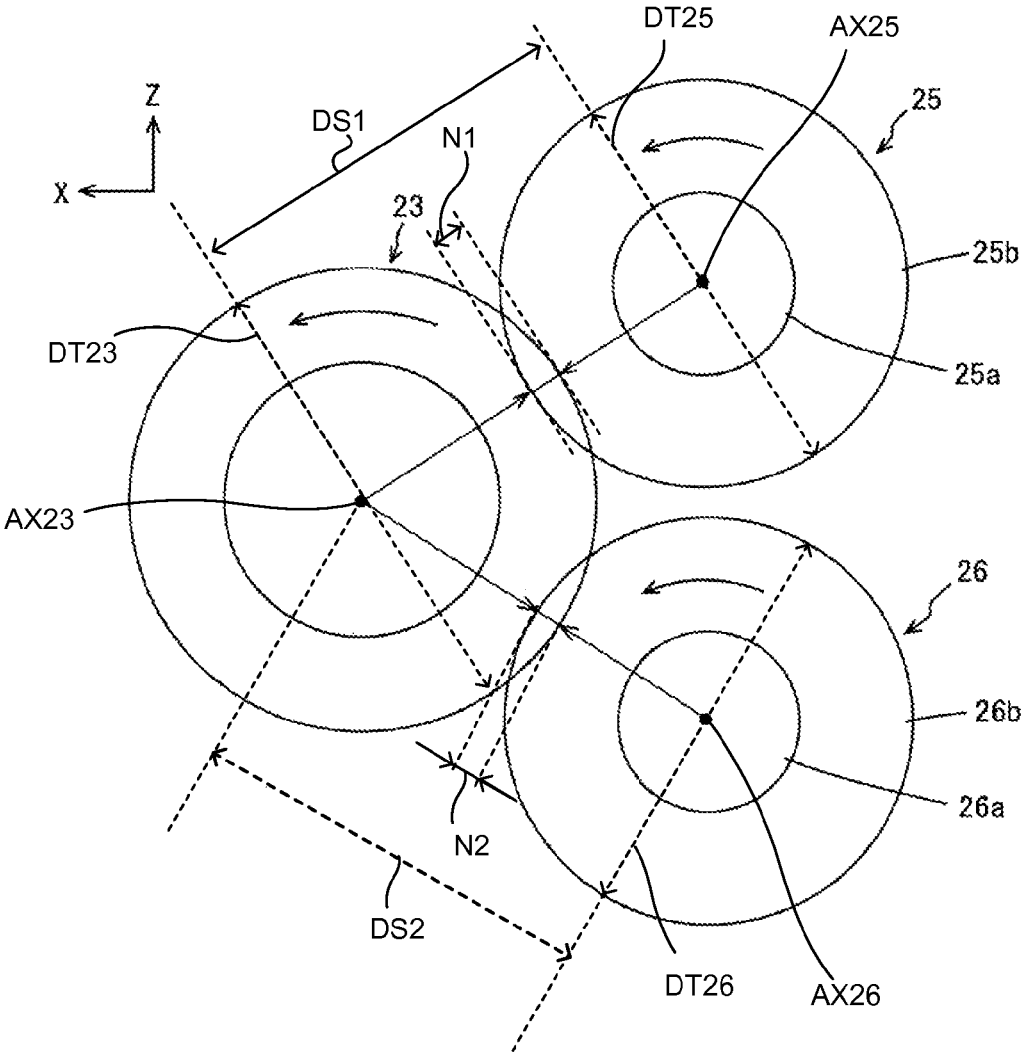
FIG. 5 is for describing a nip amount.

FIG. 5 is for describing nip amounts N1, N2 as referred to here. As illustrated in FIG. 5, the nip amount N1 here is defined as a pressing amount that is measured from a position where the development roller 23 and the first supply roller 25 become in contact each other to a position where they are pushed by each other with a predetermined pressure. Similarly, the nip amount N2 is defined as a pressing amount that is measured from a position where the development roller 23 and the second supply roller 26 become in contact each other to a position where they are pushed with a predetermined pressure. Actually, by the pushing in, the development roller 23 and the first supply roller 25, and the development roller 23 and the second supply roller 26, are in surface contact with each. Hereinafter, this surface contact part may be referred to as a nip part.

(1) Nip Amounts N1 and N2

The nip amounts N1 and N2 illustrated in FIG. 5 are measured with their diameters (DT23, DT25, DT26) and distances (DS1, DS2) between their axes (AX23, AX25, AX26). These elements above satisfy the following equations:

$$N1=DT23/2+DT25/2-DS1$$

$$N2=DT23/2+DT26/2-DS2$$

wherein, a diameter of roller 23 is DT23, of roller 25 is DT25, of roller 26 is DT26. An axis of roller 23 is AX23, of roller 25 is AX25, of roller 26 is AX26. An axis distance between AX23 and AX25 is DS1, another axis distance between AX23 and AX26 is DS2, Here, a print test 1 is described in the following that was performed in order to properly set the outer diameters D11, D12, D13 of the first supply roller 25 and the outer diameters D21, D22, D23 of the second supply roller 26 in order to suppress vertical streaks that occur during printing.

Test Results

The print test 1 was performed by preparing a plurality of supply rollers as test samples for each of which the outer diameter D12 of the first supply roller 25 and the outer diameter D22 of the second supply roller are different, and was performed under the following test conditions. (1) For the first supply roller 25 and the second supply roller 26, a material that is formed using silicone rubber pound as a base was used. (2) The cells 25*c* of the conductive foam layer 25*b* are each an independent closed cell with a hardness in a range of 45-65° when measured with an Asker F hardness meter. In the present test, a material with a hardness of 58° was used. The same also applies to the conductive foam layer 26*b*. (3) The cells 25*c* have a size in a range of 100 μm-1000 μm in general. In the present test, on a surface of the conductive foam layer 25*b*, the cells 25*c* have a size in a range of 200-400 μm. The same also applies to the conductive foam layer 26*b*. (4) It is good that resistance of the first supply roller 25 is adjusted to be in a range of 0.1 MΩ-100 MΩ when an SUS ball bearing having a width of 2.0 mm and a diameter of 6.0 mm is brought into contact with a force of 20 gf and a voltage of 300 V is applied from the core shaft (shaft) 25*a* while the first supply roller 25 is rotated. However, in the present test, the resistance was 1 MΩ. The same also applies to the second supply roller 26. (5) The conductive foam layer 25*b* has the width W of 220.0 mm. The measurement positions of the outer diameter D11, D12, D13 of the first supply roller 25 are as described in FIG. 4. The nip amounts N11, N12, N13 are also the contact nip amounts between the first supply roller 25 and the development roller 23 at the measurement positions described in FIG. 4. The same also applies to the second supply roller 26. (6) As a testing machine for evaluation, a machine having a main part configuration that is the same as that of the printer 1 was used. (7) A development unit 2 of a type having a life of 72000 drum counts is used to perform continuous durable printing. The drum count is defined in such a manner that the drum count is incremented by one when the photosensitive drum 21 makes one rotation. (8) An application bias voltage Vd=−250 V was applied to the development roller 23; an application bias voltage Vs1=−300 V was applied to the first supply roller 25; and an application bias voltage Vs2=−300 V was applied to the second supply roller 26. (9) Xerox 4200 LT 201b New92 manufactured by XEROX was used as a medium for evaluation, and a 1.25% printing pattern with respect to a printable area was printed intermittently every one page until the drum count is 72000. With respect to image results of the printing, occurrence states of vertical streaks were observed visually and using a microscope and were evaluated using ◎, ○ and x.

Table 1 in FIG. 9 illustrates results of the above print test 1, in which judging of the test results was as follows:

◎ (excellent): when there is no occurrence of vertical streaks on an image;

○ (good): when there is occurrence of vertical streaks on an image but it does become a problem at a visual level; and x (poor): when there is a problem on an image.

As illustrated in Table 1, tests (1)-(4) were performed in such a manner that the outer diameters D21, D22, D23 of the second supply roller 26 (upstream side) and the outer diameters D11, D13 of the first supply roller 25 (downstream side) were 14.0 mm, and only the outer diameters D12 of the first supply roller 25 (downstream side) were made four types that became smaller from 14.2 mm to 13.6 mm in each of which the outer diameter D12 was decreased by 0.2 mm.

Here, using the cases of the test (2) (D12=14 0 mm), for which the evaluation result was x, and the test (4) (D12=13 6 mm), for which the evaluation result was ○, as examples, factors that cause vertical streaks to occur are considered.

Vertical streaks occur because, when the continuous durable printing is performed, the toner 40 agglomerates due to heat and pressure, the agglomerated toner 40 clogs the press-contact part between the development roller 23 and the development blade 24, and the toner 40 in the clogged part is not attached to the photosensitive drum 21. FIG. 6 is for describing a process in which vertical streaks occur in the test (2) (D12=14.0 mm). With reference to FIG. 6, the process in which vertical streaks occur in the test (2) is described in the following.

FIG. 6 illustrates a flow of the toner 40 of the whole toner container 38 of the development unit 2. Here, it is assumed that charging, supply, crapping off and the like, of the toner 40 that are performed in a common development process are constantly performed. The toner 40 that is replenished from the toner supply port 35 is replenished in a vertically downward direction via a path a indicated by an arrow. Due to the toner agitation mechanism 37 on the toner receiving part 36, about half of the toner 40 that is replenished in the vertically downward direction moves to two end portions in a longitudinal direction (Y-axis direction) of the toner container 38 via paths b indicated by arrows.

Thereafter, the toner 40 that is distributed in respective parts and has reached the first supply roller 25 and the second supply roller 26 repeats a swiveling movement via paths c indicated by arrows in the respective regions where the toner 40 is distributed, along with the rotations of the first supply roller 25 and the second supply roller 26, and is consumed by development in the respective regions. When the continuous durable printing is performed, the toner 40 moves inside the toner container 38 in the above-described flow. However, the toner 40 gradually accumulates on two end portions 38*a*, 38*b* (dotted circles in FIG. 6) and finally agglomerates to cause vertical streaks to occur from the two end portions.

The flow of the toner 40 tends to be aggregated toward the two end portions. Tow ends of the toner container 38 are partitioned by walls. Therefore, at the two end portions, pressure applied on the toner 40 is increased. Further, a commonly image-formed pattern is mostly in the central portion. Therefore, toner consumption due to development occurs mostly in the central portion and very little in the two end portions 38*a*, 38*b* that correspond to two side marginal portions of the medium. Therefore, in the two end portions 38*a*, 38*b*, stress on the toner 40 increases and this becomes a factor for the toner 40 to agglomerate. In this test, in a place where vertical streaks occurred, an agglomeration degree of the toner 40 when the drum count is 72000 is more than 60% and is increased by more than 30% from an initial state. As will be described later, vertical streaks occur and a level of causing a problem on an image has been reached.

FIG. 7 illustrates a flow of the toner 40 of the whole toner container 38 of the development unit 2 in the test (4) (D12=13.6 mm) for which the evaluation result was ○. Here, it is assumed that charging, supply, crapping off and the like, of the toner 40 that are performed in a common development process are constantly performed.

Movement paths a, b, c of the toner 40 similarly occur as in the case of FIG. 6 in which the test (2) is described. However, in the test (4), by using the first supply roller 25 having the outer diameter D12 of 13.6 mm, a toner movement is newly generated in which the whole toner 40 flows in the toner container 38 as indicated by a movement path d.

That is, powder moves toward where pressure is low. Therefore, a flow (path d) of the toner 40 is generated in which, near the first supply roller 25 (downstream side), the toner 40 moves from the two end portions of the axial direction, where the nip amount is large, to the central portion and, along with this, near the second supply roller 26 (upstream side), the toner 40 moves from the central portion of the axial direction to the two end portions. As a result, the toner 40 remained in the two end portions 38*a*, 38*b* decreases and the life until vertical streaks occur can be extended.

In this test, the agglomeration degree of the toner 40 when the drum count is 72000 is about 54% and is increased by about 20% from the initial state. However, as will be described later, the level of causing a problem on an image has not been reached.

Figure 8:
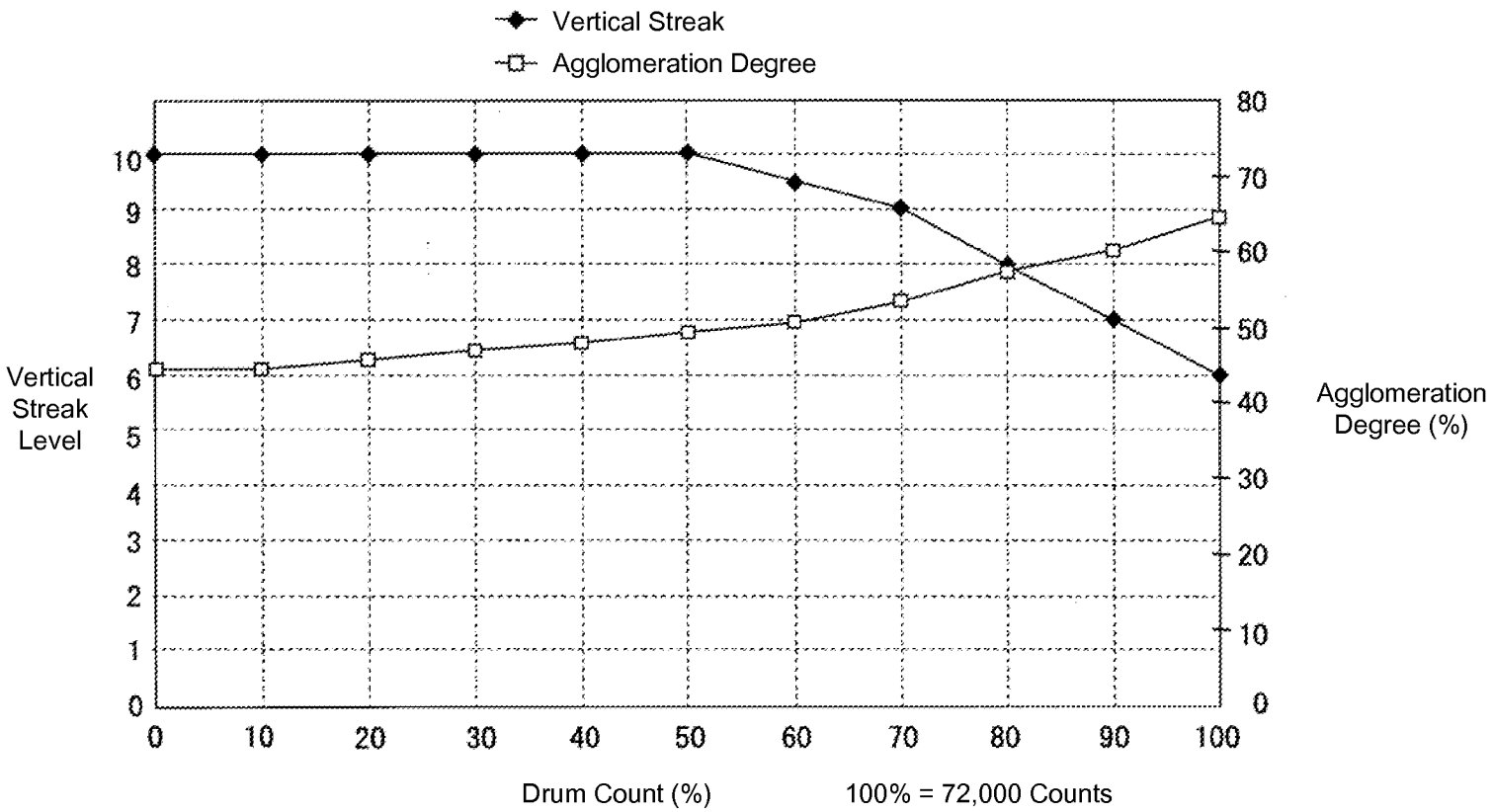
FIG. 8 illustrates a graph illustrating general relations between a drum count, a toner agglomeration degree and vertical streaks.

FIG. 8 illustrates a graph illustrating general relations between the drum count, the toner agglomeration degree and vertical streaks. In the graph, a vertical axis indicates a vertical streak level, of which a numerical value decreases according to an occurrence amount of vertical streaks from a level 10 when there is no occurrence of vertical streaks, and the agglomeration degree. A horizontal axis indicates the drum count in percentage (100%=72000 counts).

As illustrated by the graph, the agglomeration degree of the toner 40 in the toner container 38 is increased by repeating the printing operation. In the example of FIG. 8, the agglomeration degree of the initial state of the toner 40 is about 45%. However, as the drum count advances, when the agglomeration degree is around 50%, a sign of vertical streaks appears. When the agglomeration degree is more than 57%, vertical streaks occur that can cause a problem on an image. Therefore, in judging the above test results of table 1, a range of the agglomeration degree of less than 50% is judged as a ◎ range in which there is no occurrence of vertical streaks on an image; a range of the agglomeration degree of equal to or above 50% and less than 57% is judged as a ○ range in which, although vertical streaks occur on an image, the occurrence is at a level that does cause a problem at the visual level; and a range of the agglomeration degree of equal to or above 57% is judged as a x range in which vertical streaks occur that can cause a problem on an image. These judgings are results when the life of the development unit 2 is 72000 drum counts.

The test results of table 1 are described in the following. In the description of the test, for convenience, all lower side supply rollers adopted as samples were taken as the first supply roller 25 (downstream side) and all upper side supply rollers adopted as samples were taken as the second supply roller 26 (upstream side) in the description. However, those corresponding to the first supply roller 25 and second supply roller 26 of the present invention are the upper side supply rollers and the lower side supply rollers of combinations for which streak judging was ○ or ◎.

About the result of the test (2), the outer diameters D11, D12, D13 of the first supply roller 25 (downstream side) and the outer diameters D21, D22, D23 of the second supply roller 26 (upstream side) were the same (14.0 mm). Therefore, the contact nip amounts N11, N12, N13, N21, N22, N23 with the development roller 23 were also all the same (0.5 mm). In this case, as described in the above, when the drum count was 72000, vertical streaks that can cause a problem on an image occurred.

About the result of the test (1), with respect to the settings of the test (2), the outer diameter D12 of the first supply roller 25 (downstream side) was 14.2 mm and the contact nip amount N12 was 0.6 mm. In this case, when the drum count was 72000, vertical streaks that can cause a problem on an image occurred. Vertical streaks occurred at a count number smaller than the test (2). This is considered to be because the toner 40 was more aggregated toward the two end portions 38*a*, 38*b* (FIG. 6) due to that the outer diameter D12 and the nip amount N12 of the central portion of the first supply roller 25 (downstream side) were increased.

About the result of the test (3), with respect to the settings of the test (2), the outer diameter D12 of the first supply roller 25 (downstream side) was 13.8 mm and the nip amount N12 was 0.4 mm. In this case, when the drum count was 72000, vertical streaks that can cause a problem on an image did not occur. However, the agglomeration degree rose to 56% so the margin in the continuous durable printing was small, About the result of the test (4), with respect to the settings of the test (3), the outer diameter D12 of the first supply roller 25 (downstream side) was further made smaller by 0.2 mm to be 13.6 mm and the nip amount N12 was 0.3 mm. In this case, similar to the test (3), vertical streaks that can cause a problem on an image did not occur. Further, the agglomeration degree also became 54%, and the margin in the continuous durable printing also slightly improved as compared to the test (3).

When the central portion outer diameter D12 of the first supply roller 25 (downstream side) is made smaller than 13.6 mm and the nip amount N12 is made smaller than 0.3 mm, vertical streaks that can cause a problem on an image no longer occur. However, in this case, dirt that can cause another problem on an image is likely to occur, and when the nip amount N12 is equal to or less than 0.2 mm, the dirt occurs. The first supply roller 25 and the second supply roller 26 contact each other and rotate in an opposite direction (opposite direction with respect to a contact surface of the development roller 23) to the development roller 23, and thereby have three basic characteristics including supplying the toner 40 to the development roller 23, frictionally charging the toner 40, and further scraping off excess toner 40 on the development roller 23. However, when the contact nip amount with the development roller 23 is less than 0.3 mm, the excess toner 40 on the development roller 23 is hard to be scraped off, and when the contact nip amount is 0.2 mm or less, the excess toner 40 cannot be scraped off. Therefore, the excess toner 40 remains being attached to the photosensitive drum 21 and becomes dirt on an image. Therefore, it is considered that the shape of the first supply roller 25 (downstream side) adopted in the test (4) is the most appropriate shape.

As illustrated in table 1, tests (13)-(16) were performed by using the first supply roller 25 (downstream side) (the outer diameter D11=14.0 mm, the outer diameter D12=13 6 mm and the outer diameter D13=14 0 mm) adopted in the test (4) and using a supply roller (upstream side) that was formed by making only the central portion outer diameter D22 of the second supply roller 26 (upstream side) larger from 14.2 mm to 14.8 mm in four steps in each of which the outer diameter D22 was increased by 0.2 mm. The outer diameters D21, D23 of the second supply roller 26 (upstream side) are both 14.0 mm.

About the result of the test (13), with respect to the settings of the test (4), the outer diameter D22 of the second supply roller 26 (upstream side) was 14.2 mm and the nip amount N22 was 0.6 mm. In this case, when the drum count was 72000, a good print was obtained without occurrence of vertical streaks that can cause a problem on an image.

About the results of the tests (14)-(16), as a result of further increasing the outer diameter D22 of the second supply roller 26 (upstream side) and the nip amount N22, in any of the tests, vertical streaks that can cause a problem on an image did not occur. However, in the tests (15) and (16), the central portion nip amount N22 is increased by 50% more than the other nip amounts N21 and N23, so it is necessary to pay attention to a driving load torque of the development unit 2 that has become large. Therefore, the configurations of the tests (13) and (14) that are generally load-balanced are desirable.

Based on the above results, it is good for the first supply roller 25 (downstream side) to have a shape in which the nip amount is smaller at the central portion than at the end portions. When the occurrence of vertical streaks is considered, it is preferable that a difference (nip difference) between the end portion nip amounts N11, N13 and the central portion nip amount N12 is 0.1 mm or more. Further in this case, it is preferable that a diameter difference between the end portion outer diameters D11, D13 and the central portion outer diameter is 0.2 mm or more. Further, when the nip difference and the diameter difference become large, although vertical streaks are reduced, dirt is likely to occur when the difference between the end portion nip amounts N11, N13 and the central portion nip amount N12 becomes larger than 0.3 mm. Further, in this case, it is preferable that the diameter difference between the end portion outer diameters D11, D13 and the central portion outer diameter is 0.6 mm or less. In order to effectively realize an advantage of the invention, a nip difference N1dif that is measured from the central portion nip amount N12 to either of the end portion nip amount N11, N13 preferably ranges within the following:

$$0.1\ \text{mm} \leq N1\text{dif} \leq 0.3\ \text{mm}.$$

In the similar way, a diameter difference D1dif that is measured from the outer diameter D12 of the central portion and either of the outer diameters of end portion preferably ranges within the following:

$$0.2\ \text{mm} \leq D1\text{dif} \leq 0.6\ \text{mm}.$$

Further, it is good for the second supply roller 26 (upstream side) to have a shape in which the nip amount at the central portion is equal to or larger than that at the end portions. Here, "equal to" means that the central portion nip amount N22 is in a range of 90%-110% with respect to the end portion nip amounts N21, N23 and means that the central portion outer diameter D22 is in a range of 90%-110% with respect to the end portion outer diameters D21, D23. Further, when reducing occurrence of an excessively large driving torque load is considered, it is preferable that a difference (nip difference) between the end portion nip amounts N21, N23 and the central portion nip amount N22 is 0.0 mm or more and 0.5 mm or less. This is because an excessively large load is likely to occur when the nip difference is more than 0.5 mm. Further, it is more preferable that the nip difference is 0.1 mm or more and 0.4 mm or less. Further, in this case, it is preferable that a diameter difference between the end portion outer diameters D21, D23 and the central portion outer diameter D22 is 0.0 mm or more and 1.0 mm or less. This is because an excessively large load is likely to occur when the diameter difference is more than 1.0 mm. Further, it is more preferable that the diameter difference is 0.2 mm or more and 0.8 mm or less.

Further, about relations between the outer diameter differences and the nip differences of the first supply roller 25 (downstream side) and the second supply roller 26 (upstream side), it is more effective when an outer diameter difference absolute value and a nip difference absolute value of the first supply roller 25 (downstream side) are larger than those of the second supply roller 26 (upstream side). Here, the best relations are when the outer diameter difference absolute value is 0.2 mm and the nip difference absolute value is 0.1 mm.

The outer diameters and the nip amounts of the supply rollers depend on the size, life, speed and configuration of the development unit 2 that is used and various types of materials in the development unit 2. Therefore, it is preferable that specific values thereof are appropriately determined by tests as described above.

Further, in the present embodiment, the first supply roller 25 has an inverted crown shape and the second supply roller 26 has a regular crown shape. However, the present invention is not limited to this. It is also possible that the first supply roller 25 has a regular crown shape and the second supply roller 26 has an inverted crown shape. Further, in the present embodiment, the first supply roller 25 and the second supply roller 26 are both arranged in a manner that a predetermined nip amount is formed with the development roller 23. However, the present invention is not limited to this. To an extent that a toner movement is generated in which the toner entirely flows in the toner container 38 as illustrated by the movement path d of the toner 40 in FIG. 7, various embodiments are possible, for example, it is also possible that the first supply roller 25 and/or the second supply roller 26 are separated away from the development roller 23.

As described above, according to the development unit of the present embodiment, in which the outer diameter D12 and the nip amount N12 of the central portion of the first supply roller 25 (downstream side) are made smaller than those of the end portions, the outer diameter D22 and the nip amount N22 of the central portion of the second supply roller 26 (upstream side) are made equal to or larger than those of the end portions, and the outer diameter difference absolute value and the nip difference absolute value of the first supply roller 25 (downstream side) are larger than those of the second supply roller 26 (upstream side), in an image forming apparatus adopting this development unit, it is possible to obtain a good print image without occurrence of vertical streaks over a long period of time.

Second Embodiment

A print test 2 is described in the following that was performed in order to more effectively set the DC development bias voltage Vd that is applied to the development roller 23 by the development roller voltage power source 123 (FIG. 3), the DC first supply bias voltage Vs1 that is applied to the first supply roller 25 (downstream side) by the supply roller voltage power source 124, and the DC second supply bias voltage Vs2 that is applied to the second supply roller 26 (upstream side) by the supply roller voltage power source 124, in order to suppress vertical streaks that occur during printing.

Results of the print test 2 that was performed by setting the development bias voltage Vd, the first supply bias voltage Vs1 and the second supply bias voltage Vs2 to various values are illustrated in table 2. Test conditions of the print test 2 are the same as the test conditions of the print test 1 that are described in the first embodiment and thus, description thereof is omitted. The first supply roller 25 (downstream side) and the second supply roller (upstream side) 26 that were adopted in the print test 2 are of the specifications combined in the test (13) that obtained the best result in the print test 1.

The test results of table 2 that is shown in FIG. 10 are described in the following.

About a result of a test (21), here, the application bias voltages were also adopted in the print test 1, that is, the development bias voltage Vd=−250 V; the second supply bias voltage Vs2 (upstream side)=−300 V; the first supply bias voltage Vs1 (downstream side)=−300 V. In this case, in the continuous durable printing, the drum count was 80000 when vertical streaks that can cause a problem on an image occurred.

About a result of a test (22), with respect to the settings of the test (21), the second supply bias voltage (upstream side) was decreased by 25 V in absolute value to be Vs2=−275 V. In this case, the drum count when vertical streaks occurred was increased by 1000 counts to be 81000.

About a result of a test (23), with respect to the settings of the test (22), the second supply bias voltage (upstream side) was further decreased by 25 V in absolute value to be Vs2=−250 V. However, in this case, the drum count when vertical streaks occurred was 81000, unchanged from the test (22).

About a result of a test (24), with respect to the settings of the test (21), the first supply bias voltage (downstream side) was increased by 25 V in absolute value to be Vs1=−325 V. In this case, the drum count when vertical streaks occurred was increased by 3000 counts to be 83000. This resulted in that, even when the bias voltage differences between the upstream and downstream sides are the same, the life until vertical streaks occur is more extended when the absolute value of the downstream side bias voltage is larger. This is because, by increasing the absolute value of the bias voltage of the first supply roller 25 (downstream side), a bias difference between the first supply roller 25 (downstream side) and the development roller 23 is also increased and the amount of the toner 40 supplied from the first supply roller 25 (downstream side) to the development roller 23 is also increased, and thus the movement of the toner 40 at the end portions 38*a*, 38*b* (FIG. 7) of the toner container 38 becomes more active.

About results of tests (25) and (26), with respect to the settings of the test (24), as the first supply bias voltage (downstream side) Vs1 was increased by 25 V each time in absolute value, it resulted in that the drum count until vertical streaks occurred was increased to 88000, and the life was extended by a maximum of 8000 drum counts from the test (21).

As described above, when the absolute value of the first supply bias voltage Vs1 applied to the first supply roller 25 (downstream side) is larger than the absolute value of the second supply bias voltage Vs2 of the second supply roller 26 (upstream side), a better result was obtained. Therefore, it is desirable that the relation between the absolute values of the bias voltages including the development bias voltage Vd applied to the development roller 23 is |Vs1 (downstream side)|≥|(upstream side)|>|development bias voltage Vd|.

The applied biases depend on the size, life, speed and configuration of the development unit 2 that is used and various types of materials in the development unit 2. Therefore, it is preferable that specific values thereof are appropriately determined by tests as described above.

As described above, according to the development unit of the present embodiment, in which the relation between the absolute values of the first supply bias voltage Vs1 applied to the first supply roller 25 (downstream side), the second supply bias voltage Vs2 applied to the second supply roller 26 (upstream side) and the development bias voltage Vd applied to the development roller 23 is set as Vs1 (downstream side) ≥Vs2 (upstream side)>development bias voltage Vd, in an image forming apparatus adopting this development unit, it is possible to obtain a good print image without occurrence of vertical streaks over a long period of time.

INDUSTRIAL APPLICABILITY

In the above-described embodiments, the present invention is described using a color electrophotographic printer as an example. However, the present invention is not limited to this, but is also applicable to an image forming apparatus, such as a copying machine, a facsimile, or an MFP, that uses an electrophotographic method to form an image on recording material. Further, a color printer is described, but the printer may also be a monochrome printer.

What is claimed is:

1. A development device comprising:

a developer container that contains developer;

a rotatable electrostatic latent image carrier that forms an electrostatic latent image thereon, being arranged below the developer container;

a rotatable developer carrier that provides the developer to the electrostatic latent image carrier so that the electrostatic latent image is developed with the developer to form a developer image; and rotatable first and second developer supply members that supply the developer to the developer carrier, wherein the first developer supply member and the second developer supply member are arranged next to each other and facing the developer carrier, and an outer diameter (D12) of a central portion of the first developer supply member in a rotation axis direction is smaller than outer diameters (D11, D13) of two end portions of the first developer supply member.

2. The development device according to claim 1, wherein the first developer supply member is positioned on a downstream side in a rotation direction of the developer carrier with respect to the second developer supply member.

3. The development device according to claim 1, wherein an outer diameter (D22) of a central portion of the second developer supply member in a rotation axis direction is equal to or larger than outer diameters (D21 and D23) of two end portions of the second developer supply member.

4. The development device according to claim 1, wherein the first developer supply member and the second developer supply member are both in contact with the developer carrier.

5. The development device according to claim 4, wherein where a nip amount is defined as a pressing amount that is measured from a contact position where the first developer supply member contacts the developer carrier to another position where the first developer supply member and the developer carrier are pushed each other with a predetermined pressure, and a nip amount (N12) of the central portion in the rotation axis direction between the first developer supply member and the developer carrier is smaller than nip amounts (N11, N13) of two end portions thereof.

6. The development device according to claim 4, wherein where a nip amount is defined as a moving distance that is measured from a contact position where the second developer supply member contacts the developer carrier to another position where the second developer supply member and the developer carrier are pushed each other with a predetermined pressure, and a nip amount (N22) of the central portion in the rotation axis direction between the second developer supply member and the developer carrier is equal to or larger than nip amounts (N21, N23) of two end portions thereof.

7. The development device according to claim 5, wherein a nip amount (N22) of the central portion in the rotation axis direction between the second developer supply member and the developer carrier is equal to or larger than nip amounts (N21, N23) of two end portions thereof.

8. The development device according to claim 1, wherein the first developer supply member and the second developer supply member both rotate in the same direction as the developer carrier does.

9. The development device according to claim 1, wherein an absolute value (Vs1) of a voltage applied to the first developer supply member is equal to or larger than an absolute value (Vs2) of a voltage applied to the second developer supply member, and the absolute value (Vs2) of the voltage applied to the second developer supply member is larger than an absolute value (Vd) of a voltage applied to the developer carrier.

10. An image forming apparatus comprising:

the development device according to claim 1.

11. A development device comprising:

a developer container that contains developer, having a supply port, rotatable first and second developer supply members that are arranged below the supply port so that the developer falling from the supply port reach the first and second developer supply members;

a rotatable developer carrier that is arranged in contact with the first and second developer supply members so that the developer is supplied to the developer carrier from the first and second developer supply members; and a rotatable electrostatic latent image carrier that is arranged in contact with the developer carrier, forms an electrostatic latent image thereon, and develops the electrostatic latent image with the developer supplied from the developer carrier, wherein the second developer supply member is positioned at an upstream side from a contact point (CP) with respect to the first developer supply member in a rational direction of the developer carrier, the contact point being defined as a point where the developer carrier contacts the electrostatic latent image carrier, a nip amount is defined as a pressure amount that is measured from a contact position where the first and second developer supply members respectively contact the developer carrier to another position where the first and second developer supply members and the developer carrier are pushed each other with a predetermined pressure, a difference between a nip amount of a central portion and a nip amount of an end portion of the first developer supply member is defined as a first nip difference (N1dif), the first nip difference satisfies the follow:

$$0.1\ \text{mm} \leq N1\text{dif} \leq 0.3\ \text{mm},$$

a difference between a nip amount of a central portion and a nip amount of an end portion of the second developer supply member is defined as a second nip difference (N2dif), the second nip difference satisfies the follow:

$$0.0\ \text{mm} \leq N2\text{dif} \leq 0.5\ \text{mm},$$

an outer size of the central portion of the first developer supply member is smaller than an outer size of the end portion thereof, and an outer size of the central portion of the second developer supply member is equal to or greater than an outer size of the end portion thereof.

12. The development device according to claim 11, wherein a difference between the outer size of the central portion and the outer size of the end portion of the first developer supply member is defined as a first outer difference (D1dif), the first outer difference satisfies the follow:

$$0.2\ \text{mm} < D1\text{dif} < 0.6\ \text{mm},$$

a difference between the outer size of the central portion and the outer size of the end portion of the second developer supply member is defined as a second outer difference (D2dif), the second outer difference satisfies the follow:

$$0.0\ \text{mm} \leq D2\text{dif} \leq 1.0\ \text{mm}.$$

13. The development device according to claim 12, wherein the first developer supply member is a cylindrical shape, and the outer size is an outer diameter.

14. The development device according to claim 12, wherein the second developer supply member is a cylindrical shape, and the outer size is an outer diameter.

* * * * *